US005222489A

United States Patent [19]

Garoutte

[11] Patent Number: 5,222,489

[45] Date of Patent: Jun. 29, 1993

[54] SELF REGULATING COOLED AIR BREATHING APPARATUS

[75] Inventor: Timothy R. Garoutte, Bremerton, Wash.

[73] Assignee: The United States of America as represented by the Secretary of the Navy, Washington, D.C.

[21] Appl. No.: 762,145

[22] Filed: Sep. 19, 1991

[51] Int. Cl.[5] ..... A62B 7/00

[52] U.S. Cl. ..... 128/204.15; 128/204.25; 128/205.24

[58] Field of Search ..... 128/204.15, 204.16, 128/204.18, 204.24, 204.25, 205.18, 205.24

[56] References Cited

U.S. PATENT DOCUMENTS

| | | | |
|---|---|---|---|
| 914,576 | 3/1909 | Jaubert | 128/204.18 |
| 2,104,589 | 1/1938 | Hartman | 128/204.15 |
| 3,537,449 | 11/1970 | Foxwell | 128/204.24 |
| 3,565,072 | 2/1971 | Gauthier | 128/204.15 X |
| 3,817,246 | 6/1974 | Weigl | 128/204.24 |
| 3,898,978 | 8/1975 | Marcus | 128/204.17 X |
| 3,999,541 | 12/1976 | Tabor | 128/204.15 X |
| 4,080,103 | 3/1978 | Bird | 128/204.16 X |
| 4,127,123 | 11/1978 | Bird | 128/204.25 |
| 4,174,711 | 11/1979 | Laing | 52/168 X |
| 4,237,877 | 12/1980 | Boehler | 128/204.15 |
| 4,289,126 | 9/1981 | Seireg et al. | 128/204.24 |
| 4,413,622 | 11/1983 | Austin | 128/205.24 X |
| 4,829,998 | 5/1989 | Jackson | 128/204.18 X |
| 4,838,259 | 6/1989 | Gluck et al. | 128/205.24 X |
| 5,076,267 | 12/1991 | Pasternack | 128/204.26 X |

*Primary Examiner*—V. Millin
*Assistant Examiner*—Sebastiano Passaniti
*Attorney, Agent, or Firm*—William C. Townsend; Edward J. Connors, Jr.

[57] ABSTRACT

A self-regulating apparatus for providing cooled air to multiple supplied air respirators users through a manifold automatically maintains the air supplied to the respirator users within a desired constant temperature and pressure range although the number of respirator users and the ambient temperature may vary. The apparatus includes a temperature regulator connected to a vortex tube to regulate the exhaust air exiting the vortex tube and a back pressure regulator connected to the manifold.

2 Claims, 3 Drawing Sheets

Vortex Tube Performance Curve

SELF REGULATING COOLED AIR BREATHING APPARATUS

This invention relates to a self regulating apparatus for providing cooled air to multiple supplied air respirator users in which the cooling apparatus maintains the air supplied to the respirators at a desired constant temperature and pressure automatically.

BACKGROUND OF THE INVENTION

In order to perform work in hot, hostile environments, workers are required to wear impermeable protective clothing together with supplied air respirators. It has been discovered that the use of such impermeable protective clothing inhibits the normal bodily cooling function which operates though the evaporation of body moisture. This results in heat stress which is the normal physiological response of the body to excessive heat load. Prolonged exposure to heat stress leads to heat illness such as heat rash, heat cramps, heat syncope (fainting), heat exhaustion and heat stroke. All of these are serious and heat stroke is life threatening. Not only is heat stress a serious health risk, it also reduces worker productivity and increases the frequency of errors as worker physical condition deteriorates.

One way of preventing heat stress when working in such hot, hostile environments is to reduce the length of time a worker is exposed to a heat stress inducing environment (stay time). However, the use of shorter stay times increases costs and prolongs the duration of some jobs requiring work in hot, hostile environments.

Medical studies have determined that providing breathing air at a reduced temperature results in sufficient body cooling to avoid heat stress for prolonged periods. In most applications providing breathing air at a temperature in the range of 50°–65° F. provides sufficient body cooling to permit workers to stay in a hot environment for six hours, a substantial improvement over uncooled air.

One system for providing cooled air employs a vortex tube cooler whose intake is connected to a source of respirable compressed air and whose cooled air output is connected to a manifold having fittings for connecting air hoses to multiple respirators. The amount of a cooling achieved by the vortex tube is controlled by manually controlling the exhaust valve on the hot air end of the vortex tube. This valve also controls the pressure in the manifold by varying the amount and temperature of cooled air flowing out through the cold air end of the vortex tube. Manifold pressure is also controlled by a manually operable manifold exhaust valve and must be maintained within a desired range to provide adequate air flow to respirator users. If air flow into the manifold is too high or too low, cooling performance is adversely affected. Cooling performance is also affected by inlet air pressure to the vortex tube. Excess cooling creates ice build up within the system. Whenever one or more respirator users connects or disconnects to the system or when ambient conditions vary or when intake air pressure or temperature varies, numerous manual adjustments must be made to the vortex tube exhaust valve, the manifold exhaust valve and the vortex tube intake valve in a time consuming iterative procedure to ensure optimum air cooling and air supply to the respirator users. This requires continual supervision by a trained operator as well as time consuming adjustments to reach a desired equilibrium condition. Further, the operator and cooling system must be located outside the containment of the hostile environment. This creates cooling capacity loss through the transmission line. Locating the operator inside the containment risks personnel exposure to the hostile environment.

Accordingly it is an object of the invention to provide an automatic self regulating air cooling system for respirator users.

It is a further object of this invention to provide such an automatic self regulating air cooling system which is compact, which is highly reliable, suitable for location within a hostile working environment and which has no requirement for electrical power.

SUMMARY OF THE INVENTION

A self regulating automatic cooled air apparatus for providing a constant supply of cooled air to multiple respirator users at a reduced temperature within a desired range includes a manifold having plural output connections for connecting one or more individual respirators and a vortex tube cooler connected to a supply of respirable air. A back pressure regulator is connected to the manifold to maintain a desired constant pressure within the manifold. A temperature sensor located within the manifold is connected to a temperature regulator which controls the amount of hot air exhausted by the vortex tube to regulate the amount of cooled air provided to the manifold by the vortex tube cooler under varying temperature and pressure conditions.

DESCRIPTION

Figure 1:
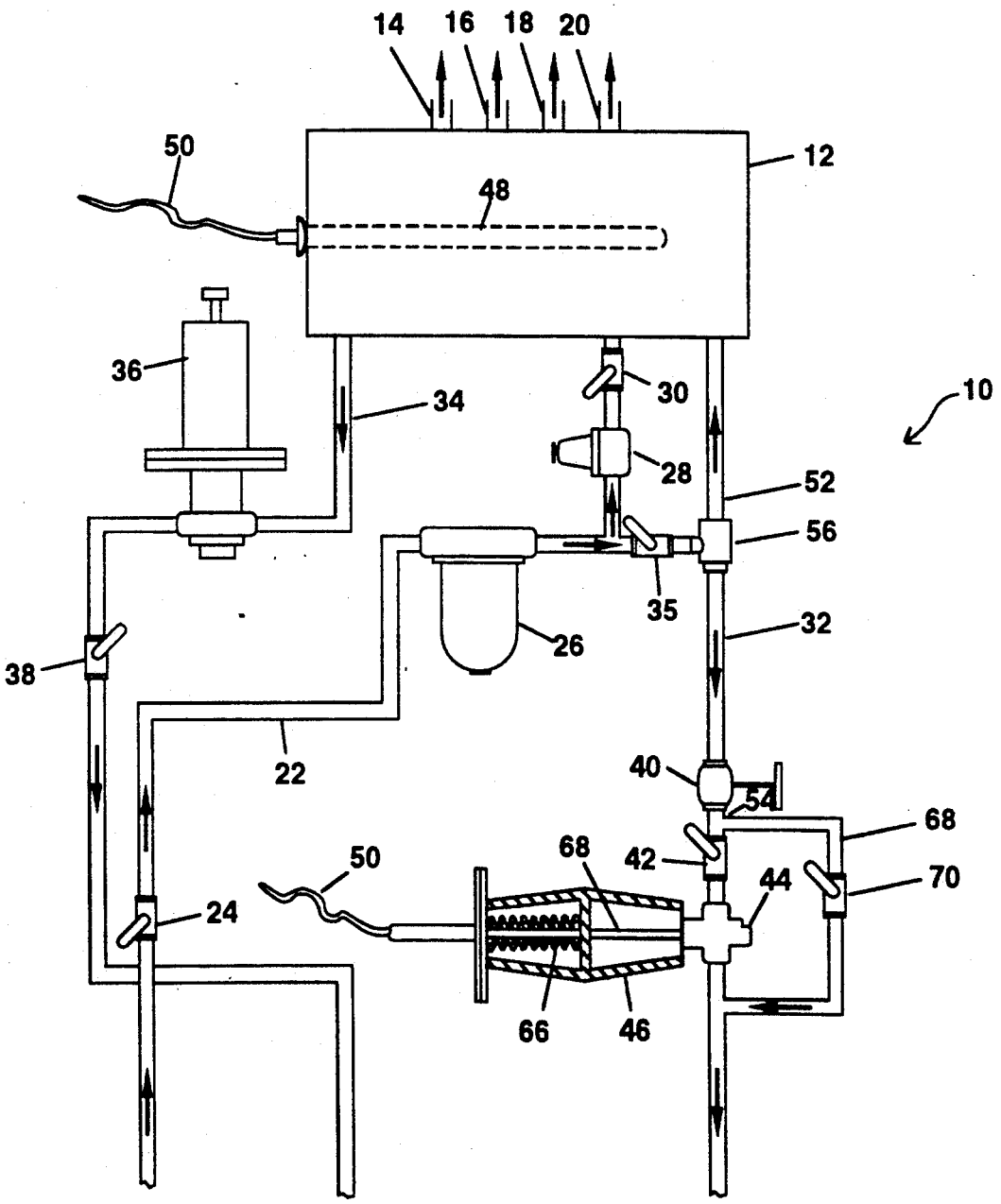
FIG. 1 is a schematic diagram of a cooled air apparatus according to the invention.

Referring to FIG. 1, there is shown at 10, a self regulating breathing air cooling apparatus according to this invention. Air cooler 10 includes a manifold 12 having multiple air outlets 14, 16, 18, and 20 for supplying air to individual supplied air respirators (not shown). Air line 22 supplies manifold 12 with air received from a standard source, not shown, of compressed respirable air at, for example, 90–105 pounds per square inch gauge (psig) through manually operated valve 24 and air filter 26. In a non-cooling mode, to be described later, air is supplied from line 22 to manifold 12 through standard regulator bypass 28 and manually operated valve 30. In a cooling mode, to be described later, air is transmitted from line 22 to manifold 12 through manually operated valve 35 to vortex tube 32. Manifold 12 exhausts air through line 34, back pressure regulator 36 and manually operated valve 38. Vortex tube 32 includes a manually operated exhaust valve 40 through which hot air is exhausted through manually operated valve 42 and valve 44 which is controlled by temperature regulator 46 which is connected to temperature sensor 48 through line 50.

Figure 3:
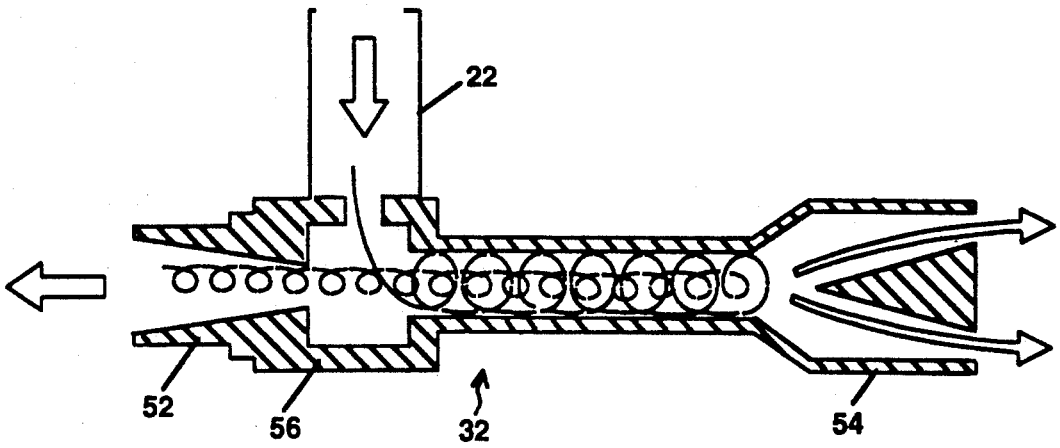
FIG. 3 is a partially schematic showing of a vortex tube employed in the invention.

Referring to FIG. 3, vortex tube 32 includes a cold air exhaust end 52 and a hot air exhaust end 54 which is controlled by valve 40. Respirable compressed air is injected tangentially from line 22 into vortex generation chamber 56 causing the air to spin as it exits the chamber and moves in a vortex motion toward hot exhaust end 54 where exhaust valve 40 allows a portion of the air to escape while the remaining air is forced back through the center of the vortex toward the cool end 52. Due to energy transfer toward the outer stream, the inner stream becomes cooler as it moves through the center toward the cool end 52 while the outer air stream becomes hotter as it moves toward the hot exhaust end 54.

Figure 4:
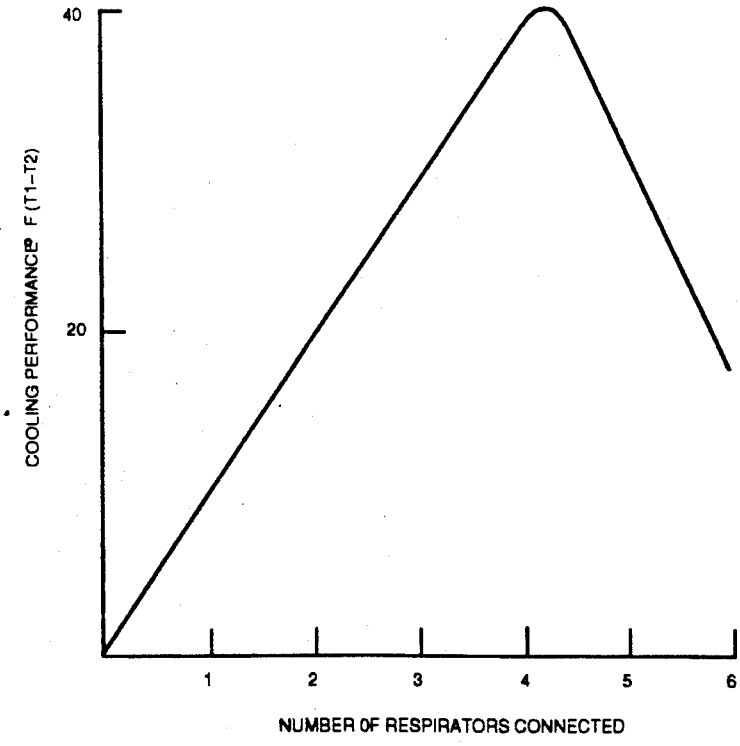
FIG. 4 is a graph of cooling performance.

The amount of cooling achieved by the vortex tube 32 is controlled by the amount of air exhausted through the hot exhaust valve 40 and by the pressure of the inlet air through valve 35. Exhaust valve 40 also controls the pressure within manifold 12 by controlling the amount of cool air flowing through cool end 52 into manifold 12. When vortex exhaust valve 40 is set and the inlet air temperature is determined, vortex tube 32 provides a fixed amount of cooling relative to the inlet air temperature (at line 22 through valve 35). Thus if the inlet air temperature is increased by 5° F. then air temperature in manifold 12 will increase by 5° F. As can be seen in FIG. 4, maximum cooling performance is achieved when an optimum four respirators are connected to the manifold.

Figure 2:
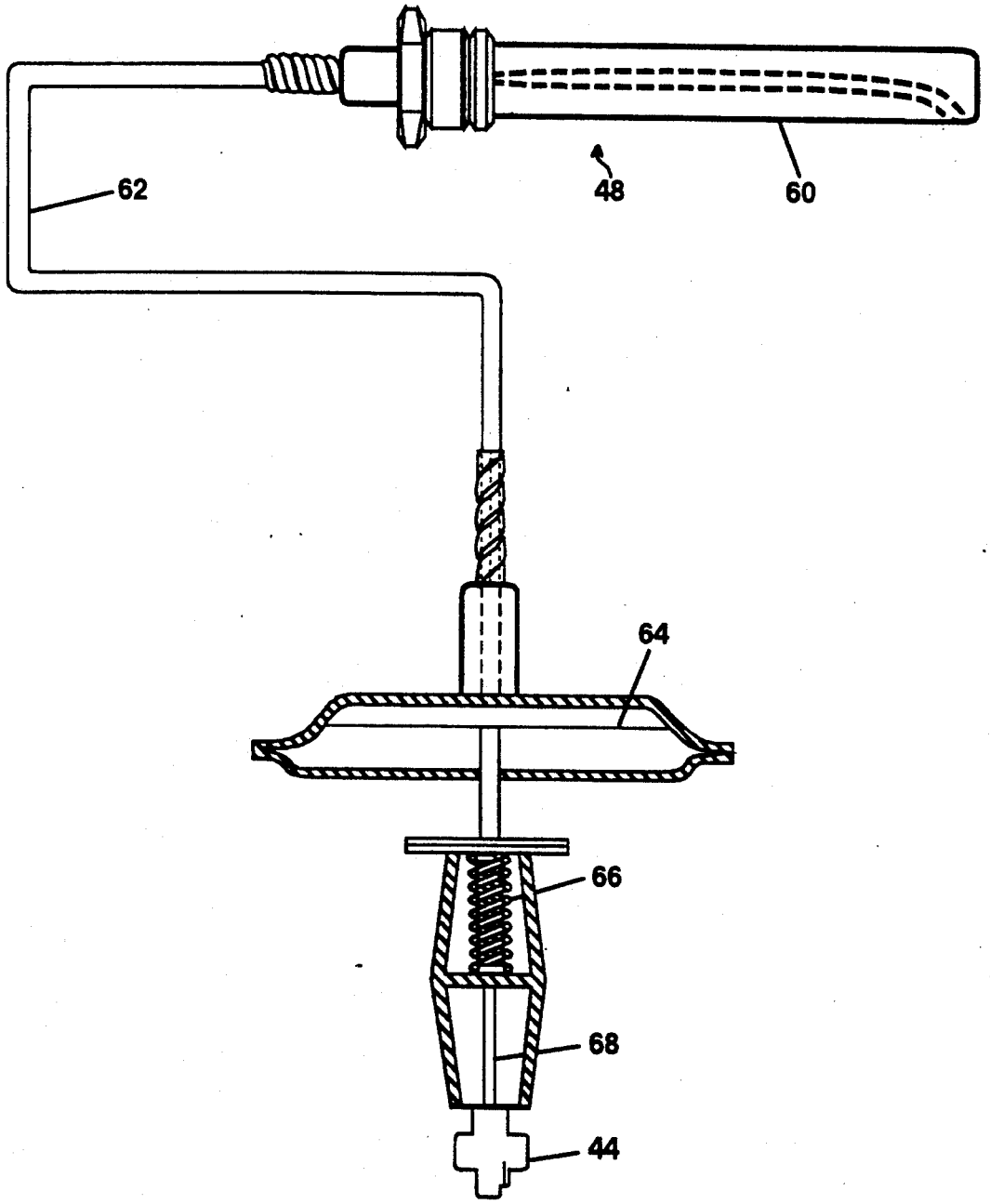
FIG. 2 is a partial schematic showing of a temperature sensor and temperature regulator employed in the invention.

Referring to FIG. 2, there is shown a temperature sensor 48 which includes a sensing bulb 60 which contains a volatile liquid which vaporizes when the temperature rises thus increasing the pressure in the bulb which is transmitted through tube 62 to diaphragm 64, movement of which against spring 66 drives a valve stem 68 to open valve 44.

In one form of operation the vortex tube 32 uses inlet air at a pressure of from 90–110 pounds per square inch gauge (psig) and the vortex tube 32 is a Vortec brand 100 scfm (standard cubic feet per minute) 6000 British Thermal Unit of Heat (btuh) capacity. The cooling capacity of vortex tube 32 is approximately 55° F. at 95 psig inlet pressure and 20 psig manifold pressure. Manifold back pressure regulator 36 is set to achieve a constant desired manifold pressure. In the arrangement shown in FIG. 1, up to four respirators can be connected to manifold 12. When less than four respirators are connected, the back pressure regulator releases the necessary volume of air to maintain the required manifold pressure. Each respirator connection or disconnection will change manifold pressure by about 8 psig without a back pressure regulator.

When maximum cooling is not required, for example, when the inlet temperature is less than about 85°–95° F., (but above approximately 50° F.), the temperature sensor 48 and temperature regulator 46 operate to control hot exhaust from the vortex tube 32 through valve 44 to thereby reduce the cooling performance of the vortex tube. The temperature set point of regulator 46 is adjusted by adjusting the force exerted on diaphragm 64 by spring 66.

As the amount of air being exhausted from the end 54 of vortex tube 32 is decreased, the velocity of the inner and outer streams in tube 32 decreases thereby reducing the energy generated at the interface of the streams. This results in reduced cooling performance since the hot exhaust temperature decreases and the cold exhaust temperature increases. As this cooling decreases, the manifold temperature rises to a desired set point. Line 68 bypasses temperature regulator 46 through valve 70 and valves 42 and 44 during initial adjustment of vortex exhaust valve 40. When the air cooler is operated in the cooling mode, valves 24, 35, 38 and 42 are in the open position and valves 30 and 70 are closed. In the example described herein, the length and heat insulation of the hose connections between outlets 14 to 18 and the individual respirators are controlled taking into account the ambient temperature in order to reduce the cooling loss between the outlets and the respirators.

Air cooler 10 can be operated in a non-cooling mode when cooling is not required, for examples when the ambient temperature is less then outlet 45° F., and whenever the breathing system respirators are not in use. In this mode, valves 30 and 24 are open and valves 35, 38, 42, and 70 are closed. Operation in a non-cooling mode reduces air consumption and power consumption of source air compressors. It should be noted that no electrical power is required to operate the automatic cooling apparatus.

What is claimed is:

1. A cooled air breathing apparatus comprising:

means for engaging a source of respirable air;

means for cooling the air received from the source including a vortex tube connected to the source of respirable air, the vortex tube having a first end which emits relatively cool air and a second end which exhausts relatively hot air;

means for connecting a respirator to the cooling means for receiving cooled air therefrom including a manifold having a plurality of air outlets capable of being connected to individual respirators, an additional manifold outlet for exhaust of excess air and a connection to the first end of the vortex tube;

means for regulating the temperature and pressure of the cooled air, including a back pressure regulator connected to the additional manifold outlet to maintain a predetermined pressure within the manifold;

a temperature sensor located at the manifold to sense the temperature of the air therewithin, and a temperature regulator having a first connection to the temperature sensor and a second connection to a valve at the second end of the vortex tube to regulate the amount of hot air being exhausted from the vortex tube; and means for disconnecting the vortex tube from the manifold and connecting the source of respirable air to the manifold to permit operation of the apparatus in a non-cooling mode.

2. A cooled air breathing apparatus as set forth in claim 1, wherein the air delivered to the respirator is in the range of 50° F. to 65° F.

* * * * *